US011180307B2

(12) United States Patent
Savoye et al.

(10) Patent No.: US 11,180,307 B2
(45) Date of Patent: Nov. 23, 2021

(54) DEVICE FOR DISPENSING A PRODUCT IN THE FORM OF BALLS

(71) Applicant: CHANEL PARFUMS BEAUTE, Neuilly-sur-Seine (FR)

(72) Inventors: Guillaume Savoye, Paris (FR); Grégory Perbal, Verrieres le Buisson (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 10 days.

(21) Appl. No.: 16/635,431

(22) PCT Filed: Aug. 7, 2018

(86) PCT No.: PCT/FR2018/052028
§ 371 (c)(1),
(2) Date: Jan. 30, 2020

(87) PCT Pub. No.: WO2019/030452
PCT Pub. Date: Feb. 14, 2019

(65) Prior Publication Data

US 2021/0086981 A1 Mar. 25, 2021

(30) Foreign Application Priority Data

Aug. 9, 2017 (FR) ..... 1757615

(51) Int. Cl.
*A45D 40/00* (2006.01)
*B65D 83/04* (2006.01)

(52) U.S. Cl.
CPC ..... *B65D 83/0409* (2013.01); *A45D 40/00* (2013.01)

(58) Field of Classification Search
CPC ..... B65D 83/0409
See application file for complete search history.

(56) References Cited

U.S. PATENT DOCUMENTS 7,204,391 B2 * 4/2007 Toker ..... A61J 7/0076 221/208
8,727,180 B2 * 5/2014 Zonana ..... B65D 83/0409 221/241
2017/0183143 A1 6/2017 Yeo

FOREIGN PATENT DOCUMENTS

FR 2 792 621 A1 6/2017
WO WO 00/64783 A1 11/2000
WO WO 2015/001262 A1 1/2015

* cited by examiner

*Primary Examiner* — Gene O Crawford
*Assistant Examiner* — Ayodeji T Ojofeitimi
(74) *Attorney, Agent, or Firm* — Greenblum & Bernstein, P.L.C.

(57) ABSTRACT

The invention concerns a device for dispensing a product in the form of balls. It comprises a main body (1) forming a tank. The device also comprises: —a central axis (5) extending longitudinally in the main body; —a helical ramp (3) comprising a track winding around the central axis, the central axis (5) being able to rotate with respect to said helical ramp; —a pusher (4) interposed in the helical ramp, said pusher (4) being linked to the central axis (5) such that, when the central axis (5) rotates with respect to said helical ramp (3), said pusher (4) is moved along the track of the helical ramp (3); and —an actuator mounted at the second end of the main body, for causing the central axis (5) to rotate with respect to the helical ramp (3). The invention also concerns an assembly comprising such a device and balls of product.

8 Claims, 3 Drawing Sheets

DEVICE FOR DISPENSING A PRODUCT IN THE FORM OF BALLS

The present invention concerns devices for dispensing a product in the form of balls. It is in particular directed to the dispensing of cosmetic, toiletry, perfume or care products in the form of balls.

In the present document, cosmetic products encompass all make-up products for the skin, lips or superficial appendages. Toiletry products comprise shower gels, bath products, and body lotions. Perfumes designate in particular all perfuming or odoriferous compositions for application to the body. Care products comprise in particular products for application to the human or animal body to prevent or treat a pathology.

It may be advantageous to store and supply such products in a solid or semi-solid form, for example in the form of balls. The expression "semi-solid" designates a soft or pasty product, having a consistency enabling it substantially to maintain its shape when it is stored. These products may thus be stored in the form of soft balls.

According to the product envisioned, this form of storage and dispensing makes it possible to provide an accurately calibrated dose of product, and/or good preservation of the product prior to its use, and/or great facility of manipulation and use by the user.

For example, a cream for application to the body may be dehydrated in order to obtain a product of sufficiently thick consistency to be put into the form of balls, and be crushed by the user on application. This makes the dosing and application of the product very easy, in particular without risk of loss or running of the product. For certain liquid products, said product may be encapsulated in a spherical shell, which is ruptured or dissolved on use (application to the skin, dissolution in water, etc.).

In the cosmetics field, products are known that are supplied to the user in a pot, in the form of balls or capsules. The user must take the balls or capsules from the pot using a spatula, a spoon or with the hand. This is ergonomically poor and may pose problems of integrity and cleanliness of the remaining balls or capsules. This solution is furthermore of low compatibility with nomadic use. It also presents a problem of sealing. Indeed, in particular for semi-solid balls for which drying-out would make them unusable, the dispensing means must be air-tight at least between each dispensing operation. However, a pot exposes all the product it contains to the air each time it is opened. Furthermore, a pot improperly closed does not enable sufficient sealing to be ensured to avoid the drying-out of the product it contains.

In the pharmaceutical field, homeopathic products commonly take the form of granules, that is to say balls of 1 mm to 6 mm diameter. Bottles exist for homeopathic granules that are closed by a plate providing through rotation an aperture of slightly greater size than that of a granule. These devices are imperfect since the granules can become jammed behind the aperture or on the contrary be dispensed in too high a number. The use of this type of dispenser is in particular incompatible for the dispensing of soft balls which have a particular tendency to become jammed together behind the dispensing aperture.

The present invention is directed to solving at least one of the aforesaid drawbacks. The invention is thus directed to providing a device for dispensing balls of a cosmetic, toiletry, perfume or care product in the form of balls, making it possible to dispense said balls one by one without breaking them or deforming them, providing an ergonomic operation and preserving the cleanliness of the balls prior to dispensing.

The invention thus relates to a device for dispensing a cosmetic, toiletry, perfume or care product, having the form of balls. The device comprises a main body forming a reservoir, said main body having an elongate shape and comprising a first end comprising a closed bottom and an open second end which is an opposite end to said first end.

The device comprises:

- a central shaft extending longitudinally within the main body,
- a helicoidal ramp comprising a track winding around the central shaft, said central shaft being able to rotate relative to said helicoidal ramp,
- a pusher interposed within the helicoidal ramp, said pusher being linked to the central shaft so that it is rotationally fixed and free for translation along said central shaft, such that a relative rotation of the central shaft in relation to said helicoidal ramp drives a movement of said pusher along the track of the helicoidal ramp, and
- an actuator mounted at the location of the second end of the main body, and making it possible to drive the relative rotation of the central shaft in relation to the helicoidal ramp.

Such a dispenser provides a mechanism enabling the dispensing of balls of products in a desired amount, for example singly. This makes it possible to hold the balls in a closed volume, and therefore to keep them clean and without risk of being soiled on dispensing one or more balls, and, if applicable to avoid their drying-out. The use of a helicoidal ramp makes it possible advantageously to organize the storage of the balls in the main body while maximizing their quantity and at the same time limiting or eliminating the risk of jamming of the balls in the device. The helicoidal ramp also makes it possible to determine the order of dispensing of the balls. Thus, the successively dispensed balls may have different compositions. It is for example possible to alternate the dispensing of balls having a certain composition with the dispensing of balls having another composition.

The helicoidal ramp may be mounted to be rotationally fixed relative to the main body.

The device may further comprise an indexing mechanism configured such that an actuation of the actuator drives the rotation of the central shaft relative to the helicoidal ramp through a predefined angle.

In such a device, the actuator may comprise a push-button, movable between a released position and a pushed-in position, the device further comprising a return spring tending to return said push-button to the released position, the indexing mechanism further comprising a cam system transforming a press followed by a release of the push-button into the rotation through the predefined angle of the central shaft.

The push-button may be linked to the central shaft, the spring being a compression spring interposed between the bottom of the main body and a bearing surface of the central shaft.

The indexing mechanism may for example comprise a first notched ring facing a second notched ring, said first and second notched rings being rigidly linked to the central shaft, the device further comprising at least one pin rigidly linked to the main body and interposed between said first and second notched rings, said first and second notched rings forming a cam for the at least one pin for which they define a peripheral path, a press followed by a release of the push-button driving progression of the pin on said path by rotation of said first and second notched rings and, as a corollary, of the central shaft.

The first and second notched wheels may in particular be configured such that the push-button has a stable intermediate position, and such that the push-button, being actuated from said intermediate position, successively adopts:

- further to a first press of the push-button, the pushed-in position, which is unstable,
- further to a first release of the push-button, the released position, which is stable;
- further to a second press of the push-button, the pushed-in position, which is unstable,
- further to a second release of the push-button, the intermediate position, which is stable.

When the actuator is a push-button, the latter may comprise a delivery opening and the device may further comprise a shutter which closes off the delivery opening except in released position of the push-button in which the delivery opening is unobstructed.

The central shaft may have the shape of a right prism, the pusher comprising a ring the interior shape of which, with a clearance allowance, matches a base of the prism defining the central shaft, so as to be able to freely slide along said central shaft.

The invention also relates to an assembly comprising a device as described above, and balls of a cosmetic, toiletry, perfume or care product, stored on the track of the helicoidal ramp, the pitch of said helicoidal ramp and the width of its track being each being greater than the diameter of one ball but less than twice the diameter of one ball, such that said balls come into position behind each other on said track of the helicoidal ramp.

Still other particularities and advantages of the invention will appear in the following description.

In the accompanying drawings, given by way of non-limiting example:

FIG. 1 shows a device for dispensing a product in the form of balls. This device is in particular configured for dispensing balls of a cosmetic, toiletry, perfume or care product.

Figure 2:
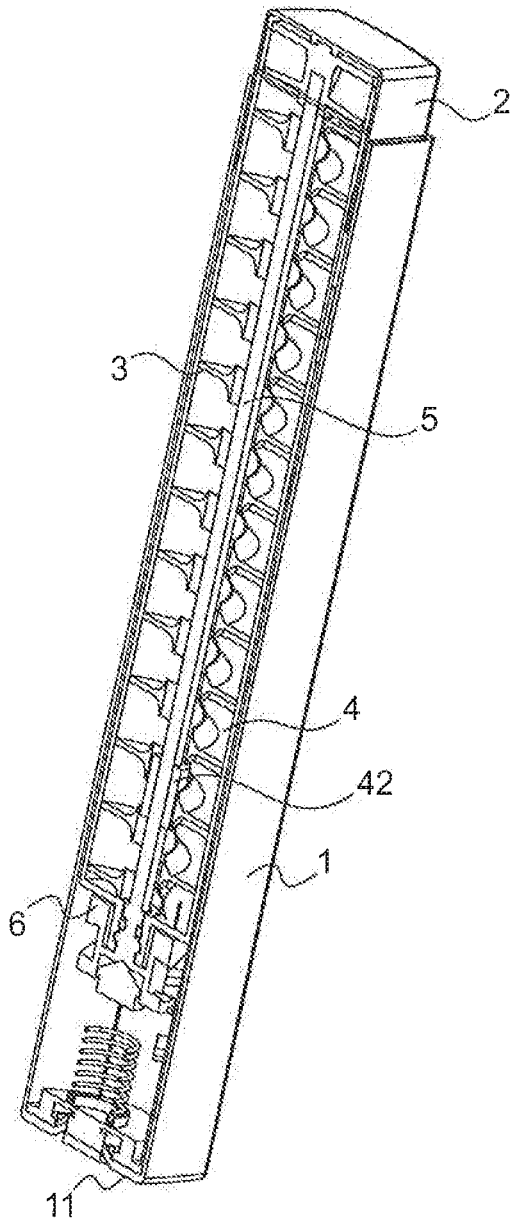
FIG. 2 shows the device of FIG. 1 in a cross-section view.

The device comprises a main body 1 configured generally for the storage of balls of product, and comprising a mechanism for dispensing said balls, which can be seen in FIG. 2. The main body 1 is of elongate shape. A first end of the main body 1 is closed off by a bottom 11. The second end comprises an actuator the operation of which enables balls of products to be delivered, one by one.

Figure 1:
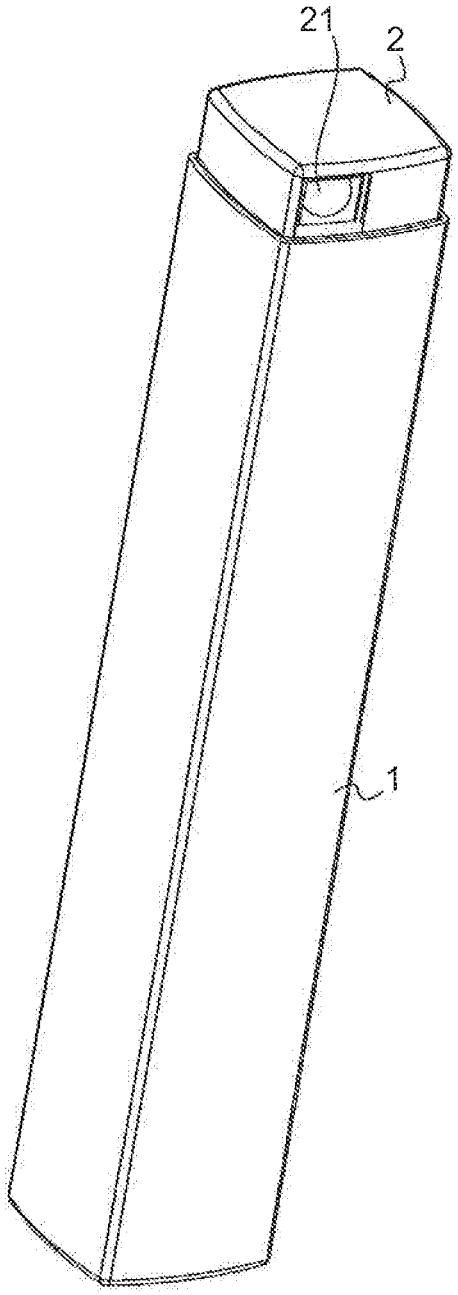
FIG. 1 shows a general view of a device in accordance with an embodiment of the invention.

In the embodiment shown here, the actuator is a push-button 2 which comprises a delivery opening 21 enabling the passage and thus the dispensing of a ball of product. The push-button 2 has at least two positions, which are:

- a released position as shown in FIG. 1 and
- a pushed-in position which the push-button 2 adopts when it is pushed in.

Figure 3:
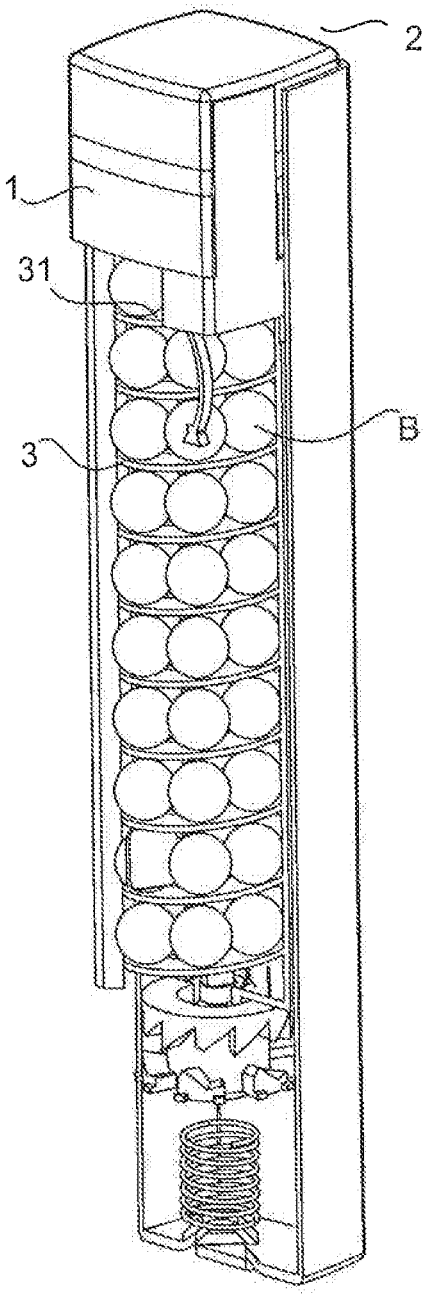
FIG. 3 shows the device of FIGS. 1 and 2 filled with balls of product, in a partially cut-away view showing the internal structure of the device.
Figure 4:
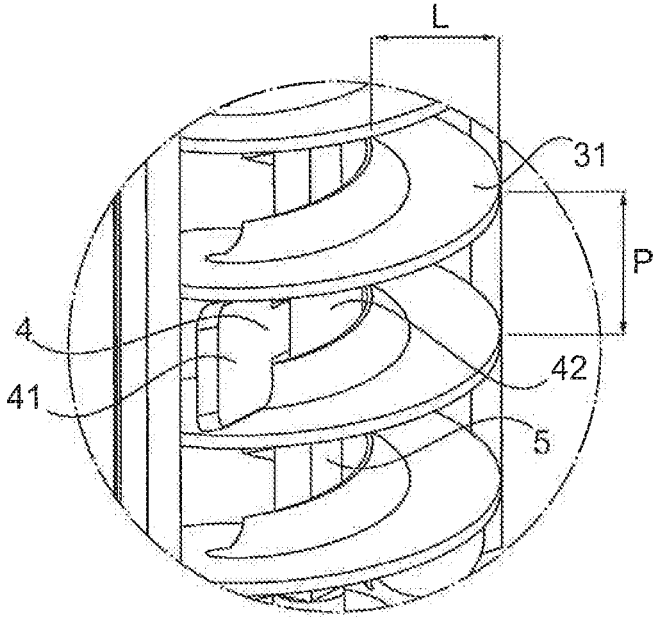
FIG. 4 shows a detail view of the device of FIGS. 1 and 2, illustrating in particular a pusher implemented in this example embodiment.

The push-button 2 of the device shown has, thanks to the indexing mechanism which will be described in more detail below with reference to FIGS. 5 and 6, a third position referred to as intermediate position, in which the push-button is partly pushed into the main body 1, as shown in FIG. 3. This intermediate position constitutes the position of stable equilibrium (in the absence of a new press applied to the push-button) in which it is provided for the push-button to be held between each use of the device for dispensing one or more balls of product.

The delivery opening 21 is unobstructed only when the push-button is in released position. Thus, only the released position enables the dispensing of a ball. In pushed-in or intermediate position, the delivery opening 21 is retracted into the main body. Where provided, it is furthermore closed by a shutter as described in more detail below with reference to FIGS. 7 and 8.

In the example embodiment shown, the main body 1 and the push-button 2 have a substantially square base. This is primarily arises from aesthetic concerns, it being possible for the main body 1 and/or the push-button to have for example a base that is circular (cylindrical main body 1), oval, hexagonal, etc.

FIG. 2 is a cross-section view of the device of FIG. 1, enabling its internal mechanism to be seen. The dispensing device comprises a helicoidal ramp 3. As shown in FIG. 3, the helicoidal ramp 3 forms a track 31 on which the balls B of product may be stored. The helicoidal ramp 3 is configured (or, to match, the balls intended for the device are configured) such that the balls come into position one behind the next on said track.

The parameters that define the geometry of the ramp and which are in particular configured for such purpose are the pitch P of the helix that forms the helicoidal ramp 3 and the width L of the track 31. These dimensions are chosen so as to enable a ball to roll freely within the ramp, without permitting that ball to swap its position on the ramp with another ball or two balls of the same diameter or at the very least of substantially the same diameter to overlap within the height of the device (along the axis of extension of the main body 1) or within the width (at the same level of the helicoidal ramp 3).

Thus, the pitch P of the helix formed by the helicoidal ramp must be greater than the diameter of a ball, and considering that the thickness of the track must be very low relative to the pitch P, this pitch P must be less than twice the diameter of a ball B. In substantially analogous manner, the width L of the track 31 must be greater than the diameter of a ball B and less than twice the diameter of a ball B.

The diameter of the balls B of product may be comprised between 3 mm and 15 mm, for example between 4 mm and 10 mm. For example, the diameter of the balls may be of the order of 5 mm. The diameter of each ball is substantially identical.

This configuration makes it possible to organize the storage of the balls in the main body as illustrated in FIG. 3. FIG. 3 illustrates a device in accordance with the embodiment of FIGS. 1 and 2, filled with balls. This makes it possible to limit or avoid any risk of balls jamming together in the device. This configuration also makes it possible to maximize the number of balls B that can be stored, while taking into account the aforementioned imperative of avoiding any jamming of balls in the device.

In order to induce the progressive rise of the balls B within the helicoidal ramp towards the delivery opening 21, a pusher 4 is provided within the ramp. The pusher 4 comprises a tab 41 interposed within the helicoidal ramp. When the device is filled with balls B, the tab 41 is positioned in contact with the ball B that is closest to the bottom 11 of the main body 1, which is also the last ball that will be dispensed when the device is emptied fully.

The pusher rises towards the second end of the main body, or, as a corollary, from the distribution opening, following the track 31 of the helicoidal ramp 3, each time a user actuates the actuator (for example the push-button 2) of the device. The pusher 4 pushes the ball bearing on the tab 41, which pushes the ball with which it is itself in contact, and so forth. All the balls B present in the device thus rise along the helicoidal ramp 3, and the ball furthest from the pusher is brought opposite the delivery opening, in order to be provided to the user.

The pusher 4 is linked to a central shaft 5 of the device. The pusher 4 is rotationally fixed relative to the central shaft 5, but free for translation along that central shaft 5. In other words, the pusher 4 has a sliding link with the central shaft 5. This link enables the pusher 4 to be raised along the helicoidal ramp 3 under the effect of rotation of the central shaft 5. The sliding link may be constituted by a central shaft 5 in the form of a right prism, that is to say the form of a rod or of a tube of polygonal (square, triangular, hexagonal, octagonal) cross-section, or the form of a rod or of a tube of any non-circular cross-section, the pusher comprising a ring 42 having an internal cross-section which matches the cross-section of the central shaft, allowing for clearance enabling the sliding of the ring 42 and thus of the pusher 4 along the central shaft 5.

The rotation of the central shaft is controlled by the actuator of the device, that is to say the push-button 2 in the represented embodiment. The device comprises a mechanism configured to transform the translation movement of the push-button 2 into rotation of the central shaft 5. FIGS. 5 and 6 illustrate in particular the mechanism implemented in the example embodiment represented here.

It is clear that it is the relative rotational movement between the central shaft 5 and the helicoidal ramp 3 which enables the movement of the pusher 3. In one embodiment of the invention, the helicoidal ramp may be able to rotate relative to the main body while the shaft is rotationally fixed relative to said main body, which drives movement of the pusher that is identical along the length of the track 31 of the helicoidal ramp 3.

Figure 5:
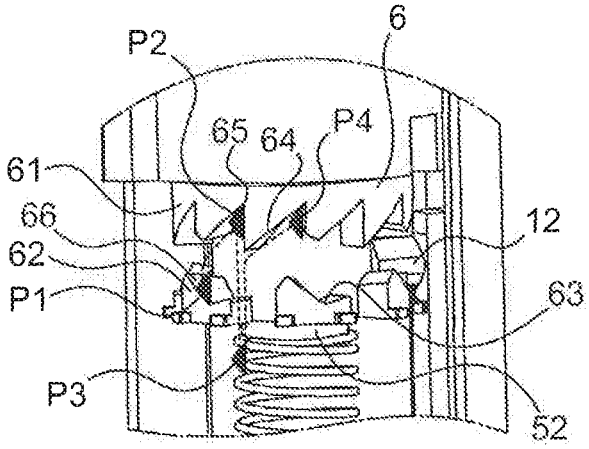
FIG. 5 shows a detail view of the device of FIGS. 1 and 2, illustrating an example of an indexing mechanism implemented in this example embodiment.

FIG. 5 is a detail view of a mechanism for indexing between the movement of the actuator, that is to say of the push-button 2, and the central shaft 5. The means represented in FIG. 5 form an indexing mechanism 6, which ensures that each press followed by a release of the push-button 2 results in a rotation of the central shaft 5 through a specific angle. This angle, which also corresponds to the angle which the pusher 4 and in particular the tab 41 describes on the track 31 of the helicoidal ramp 3 must be suited to the diameter of the balls B to dispense, or, correspondingly, the diameter of the balls must be adapted to the angle of rotation at each press of the push-button 2. Thus, a predefined number of presses, for example one, or two as in the example represented here, is required to cause progression of the balls by the equivalent of one place on the ramp 31, that is to say to advance the balls by the equivalent of one ball diameter linearly on said track, such that a ball considered takes the place of the ball it pushes towards the delivery opening.

Thus, each time the user presses and releases the push-button 2 by the predefined number of presses, a ball B is delivered.

Furthermore, as of filling the device with balls, the order in which said balls will be delivered is fixed. Thus, the successively dispensed balls may have different compositions.

This for example makes it possible to successively dispense a certain number of balls which it advantageous to mix or superpose at the time of the application. For example, a lipstick ball may be followed by a ball increasing its brilliant appearance.

The combination of different active ingredients may also present an interest for care products.

In the context of the dispensing of balls having two different compositions, the simplest delivery sequence (the balls being numbered in their order of dispensing) may be: ball No. 1 of formula A, ball No. 2 of formula B, ball No. 3 of formula A, and so forth.

The indexing mechanism 6 comprises a first notched ring 61 and a second notched ring 62. The first and second notched rings 61, 62 each comprise indentations, and are positioned facing each other. They define a peripheral path for a pin 12 which is rigidly linked to the main body. In this case, the device in the represented example comprises two pins 12, which ensures better guidance. Four pins or more could be employed.

The indexing mechanism 6 is positioned in the main body 1, near its bottom 11. In particular, the indexing mechanism 6 is positioned between the bottom 11 and the helicoidal ramp 3.

The indexing mechanism 6 is rigidly linked to the central shaft. It may be integrally formed with said central shaft 5. The push-button 2, when pressed, causes translation of the central shaft 5 and the helicoidal ramp 4 within the main body 1, towards the bottom 11 of said main body 1. More particularly, the push-button 2 bears on one end 51 of the central shaft 5. The push-button 2 also bears on one end 32 of the helicoidal ramp 3.

Figure 6:
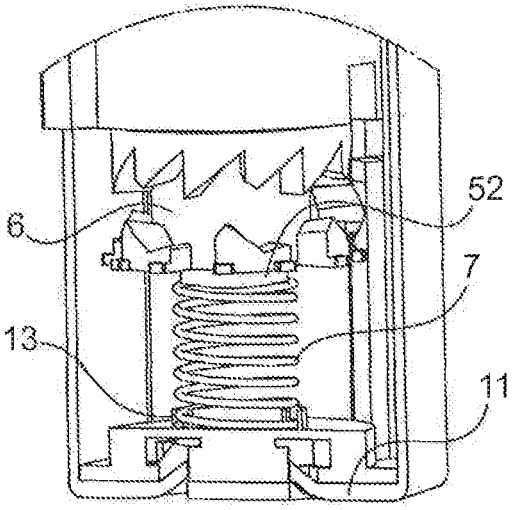
FIG. 6 shows a detail view of the device of FIGS. 1 and 2, illustrating in particular a spring implemented in this example embodiment.

The release of the push-button 2 drives a translation, in the opposite direction, of the assembly formed by the central shaft and the helicoidal ramp 4, under the effect of the compression spring 7, which can be seen in detail in particular in FIG. 6. The compression spring 7 is interposed between the bottom 11 and a bearing surface 52 of the central shaft 5. Retaining means 13 are provided on the inside surface of the main body 1 of the bottom 11 in order to hold the compression spring 7.

The teeth of the first notched ring 61 and of the second notched ring 62 form cams for the pin 12 (or for each pin 12), the conveyance of which they guide. As the pin 12 is fixed in relation to the main body 1, the interaction between the teeth of the first notched ring 61 or of the second notched ring 62 with the pin 12 drives the rotation of the notched ring in interaction with the pin 12.

In the example shown, the pin 12 (or each pin 12) will follow the path formed by the indexing mechanism 6 by taking the route represented by a dashed line in FIG. 5, and by successively taking the positions described below.

Between two actuations of the device for delivery of a ball B, the pin 12 is in a first position P1, bearing on a hollow 63 formed in the teeth of the second notched ring 62. This bearing prevents the central shaft 5 and, as a corollary, the helicoidal ramp 3, from rising in the main body 1, despite the action of the compression spring 7 which is partially compressed and thus applies a force on the central shaft 5. The first position P1 of the pin 12 corresponds to an intermediate position of the push-button 2.

When a user performs one press on the push-button 2 sufficient to compress the compression spring 7, the assembly formed by the helicoidal ramp 4 and the central shaft 5 comprising the indexing mechanism 6 descends towards the bottom 11 of the main body. The pin enters into contact with an inclined surface 64 of a tooth of the first notched ring 61 located opposite said hollow 63, inducing the rotation of said notched ring and thus of the central shaft 5 until the pin 12 reaches a second position P2, in which it abuts a vertex 65 formed by the teeth of the first notched ring 61. The second position P2 of the pin 12 corresponds to a pushed-in position of the push-button 2, that is to say to the "abutted" position of said push-button when it is pressed by the user. In the pushed-in position, the push-button 2 may typically be fully retracted into the main body 1.

The pushed-in position of the push-button 2 is unstable: the release of the press on the push-button 2 makes said push-button leave that pushed-in position, and the pin 12 leaves the second position P2, under the effect of the return force of the compression spring 7. The full release of the push-button 2 thus brings the pin 12 into a third position P3, corresponding to the released position of the push-button 2. In this position, the push-button is in the most outward position of the main body 1 that it can adopt. The compression spring 7 is said to be released (even though a residual return force may be maintained in that position to avoid any translational play at the location of the push-button). In the third position P3, the pin 12 is passed under the second notched ring 62, via a space formed between the teeth of the second notched ring 62.

A new press made by the user on the push-button 2 makes the pin 12 pass again via said space between the teeth of the second notched ring 62. The pin enters into contact with an inclined surface 64 of a tooth of the first notched ring opposite said space between the teeth of the second ring so inducing the rotation of said notched ring and thus of the central shaft 5 until the pin 12 reaches a fourth position P4, in which it abuts a vertex 65 formed by the teeth of the first notched ring 61. When the pin 12 is in the fourth position P4, the push-button is in pushed-in position. The fourth position P4 differs from the second position P2 in that the pin is opposite a tooth of the second notched ring 62 and not a space between the teeth of said notched ring 62. The position of the push-button is nevertheless identical or substantially identical, in abutment. Thus, when the push-button is released, the pin 12 intercepts a guide surface 66 of the second notched ring 62. On account of that interaction, the second notched ring 62 and thus the main axis turn until the pin 12 arrives in a hollow 63, and resumes a first position P1 (but on the tooth following the second ring 62 compared with its initial position described above).

Thus, the inclined surface 64 and the guide surface 66 form cams for the pin 12 (or the pins 12) for which they provide guidance, causing, in fine, the rotation of the central shaft 5.

As described below, a ball is delivered each time the push-button is in a released position, that is to say when the pin 12 is in the third position P3. Thus, the angle formed between two spaces between the teeth of the second notched ring 62 corresponds to the angle which the pusher 4 will describe further to two presses and two releases of the push-button 2 (a first press followed by a first release to bring the push-button into intermediate position further to the delivery of a ball of product, the intermediate position being the position desired for the device when it is not used, and a second press followed by a second release for the delivery of a new ball of product). This angle must therefore be adapted to the diameter of the ball, so as to push the balls along the track 31 by a distance substantially equal to the diameter of a ball B.

Figure 7:
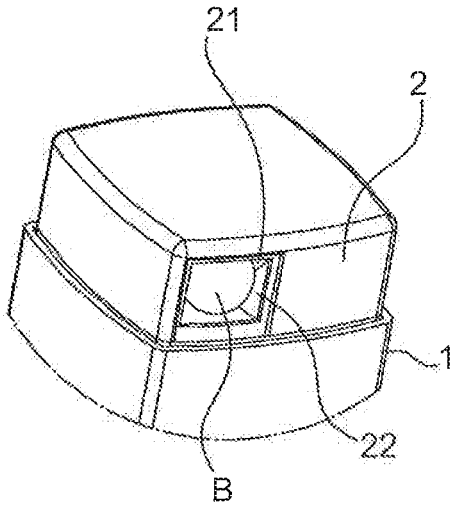
FIG. 7 shows a detail view of the device of FIGS. 1 and 2, illustrating in particular the dispensing of a ball of product by this device.

FIG. 7 illustrates the delivery of a ball B by the device. The push-button is provided with a delivery opening 21. The delivery opening 21 for delivery of a ball B is unobstructed only when the push-button is in released position. In the pushed-in and intermediate positions, the delivery opening 21 is fully retracted into the main body 1, that is to say that it is located within the main body under the level of its second end (opposite end to the first end comprising the bottom 11). The push-button 2 is presented in released position in FIG. 7. Concomitantly to the release of the push-button 2, the ball B that is to be delivered has been pushed towards the delivery opening 21 by the advancement of all the other balls stored in the device, under the action of the pusher 4. In particular, the ball B destined to be delivered is transferred from the helicoidal ramp 3 into the push-button 2, opposite the delivery opening, by guides 22. The guides 22 may also form a portion of helicoid in the push-button 2.

Figure 8:
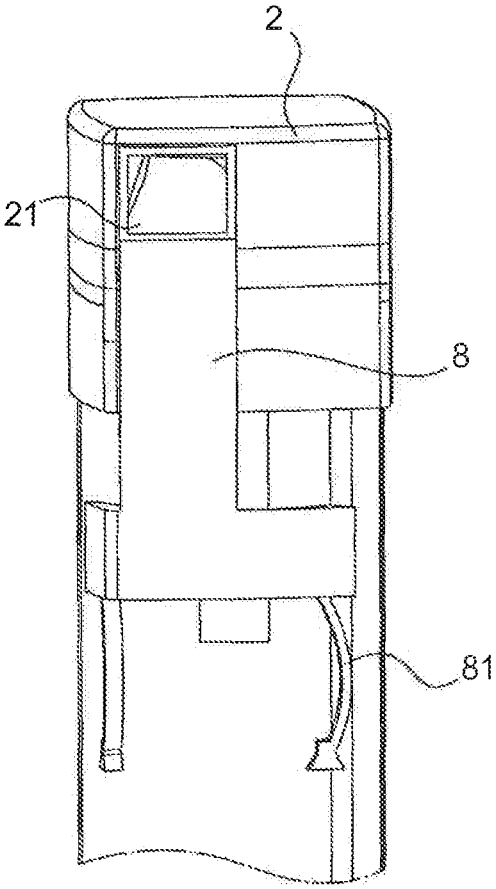
FIG. 8 shows a detail view of the device of FIGS. 1 and 2, illustrating in particular a shutter implemented in this example embodiment.

FIG. 8 shows in particular a shutter 8 operative to close off the delivery opening 21 with a certain degree of fluid-tightness, when the push-button is in intermediate position (in which position the device is kept between the delivery of two balls).

A degree of air-tightness is desirable in order to maintain the humidity of the balls when they are stored in the device. This is because the balls of product, in particular cream or lipstick, must generally be kept within a certain range of humidity in order not to dry them out. This would alter the comfort of their use, and could also reduce their size, which is not desirable.

The shutter 8 thus has a width configured for the full closing off of the delivery opening 21. It may be formed by a plastic material having a flexibility suitable to provide the desired air-tightness.

On movement of the push-button 2, the shutter 8 slides in front of the delivery opening 21. In order to enable proper closing off of the delivery opening 21 in intermediate position of the push-button 2 and furthermore to enable the movement of said push-button 2 towards the pushed-in position, the shutter is provided with flexible members 81, enabling the shutter 8 to slightly push into the main body 1 towards the bottom 11, while procuring a degree of return force when the shutter is so displaced.

Although it has been described with reference to the particular embodiment of FIGS. 1 to 8, the device may have alternative or additional features while remaining within the context of the invention. For example, the actuator employed to induce the delivery of a ball may be other than a push-button. A rotary manipulation wheel, indexed by a notch-based system, may in particular be employed. Types of spring other than a compression spring in a spiral may be employed to bring the actuator (for example the push-button) into a predefined position. The main body 1 may have various geometries, and be formed substantially of plastic material, of metal, of glass, or of wood. The same applies for the internal mechanism of the main body.

The invention thus developed provides a device for the delivery of balls of a product, in particular a cosmetic, toiletry, perfume or care product, enabling the delivery of balls singly without risk of jamming or risk of soiling the other balls stored in the device. This device is furthermore very easy to use. The device may provide aesthetic value and the manner of dispensing balls of product, in particular when that delivery takes place in the upper part of the device, is attractive for the user.

The invention claimed is:

1. A dispensing device for dispensing a cosmetic, toiletry, perfume or care product formed as balls, said dispensing device comprising:

a main body forming a reservoir, said main body having an elongate shape and comprising a first end comprising a closed bottom and an open second end, said open second end being an end opposite said first end;

a central shaft extending longitudinally within the main body;

a helicoidal ramp comprising a track winding around the central shaft, said central shaft being configured to rotate in relation to said helicoidal ramp;

a pusher interposed within the helicoidal ramp, said pusher being linked to the central shaft so that the pusher is rotationally fixed and free for translation along said central shaft, such that a relative rotation of the central shaft in relation to said helicoidal ramp drives a movement of said pusher along the track of the helicoidal ramp;

an actuator mounted at a location of the second end of the main body and configured to enable the relative rotation of the central shaft to be driven in relation to the helicoidal ramp; and an indexing mechanism configured such that an actuation of the actuator drives the rotation of the central shaft in relation to the helicoidal ramp through a predefined angle;

wherein:

the actuator comprises a push-button, movable between a released position and a pushed-in position;

the dispensing device further comprising a return spring tending to return said push-button to the released position;

the indexing mechanism further comprising a cam system transforming a press followed by a release of the push-button into the rotation through the predefined angle of the central shaft.

2. A dispensing device according to claim 1, wherein:

the push-button comprises a delivery opening; and the dispensing device further comprises a shutter that closes off the delivery opening except in released position of the push-button in which the delivery opening is unobstructed.

3. A dispensing device according to claim 1, wherein:

the central shaft has a shape of a right prism, the pusher comprising a ring having art interior shape with a clearance allowance matching a base of the prism defining the central shaft, so as to be able to freely slide along said central shaft.

4. An assembly comprising:

a dispensing device according to claim 1; and balls of a cosmetic, toiletry, perfume or care product, stored on the track of the helicoidal ramp;

wherein each of a pitch of said helicoidal ramp and a width of the track of the helicoidal ramp being greater than a diameter of one of the balls but less than twice said diameter, such that said balls come into position behind each other on said track of the helicoidal ramp.

5. A dispensing device according to claim 1, wherein:

the helicoidal ramp is mounted to be rotationally fixed in relation to the main body.

6. A dispensing device according to claim 1, wherein:

the push-button is linked to the central shaft, the return spring being a compression spring interposed between the bottom end of the main body and a bearing surface of the central shaft.

7. A dispensing device according to claim 1, wherein:

the helicoidal ramp is mounted to be rotationally fixed in relation to the main body; and the indexing mechanism comprises a first notched ring facing a second notched ring, said first and second notched rings being rigidly linked to the central shaft;

the dispensing device further comprising at least one pin rigidly linked to the main body and interposed between said first and second notched rings;

said first and second notched rings forming a cam for the at least one pin for which the first and second notched rings define a peripheral path;

a press followed by a release of the push-button driving progression of the pin on said peripheral path by rotation of said first and second notched rings and, as a corollary, of the central shaft.

8. A dispensing device according to claim 7, wherein:

the first and second notched wheels are configured such that the push-button has a stable intermediate position; and such that the push-button, being actuated from said intermediate position, successively adopts the following:

further to a first press of the push-button, the pushed-in position, which is unstable;

further to a first release of the push-button, the released position, which is stable;

further to a second press of the push-button, the pushed-in position, which is unstable; and further to a second release of the push-button, the intermediate position, which is stable.

* * * * *